US005189851A

United States Patent [19]

Omika et al.

[11] Patent Number: 5,189,851

[45] Date of Patent: Mar. 2, 1993

[54] MOVABLE DOME-TYPE ROOF FOR STRUCTURE

[75] Inventors: Yukihiro Omika; Kuniaki Sato; Eiji Matsushita; Kazuo Kojima; Tsutomu Kumazawa; Yasuo Ogawa, all of Tokyo, Japan

[73] Assignee: Kajima Corporation, Tokyo, Japan

[21] Appl. No.: 759,744

[22] Filed: Sep. 12, 1991

Related U.S. Application Data

[63] Continuation-in-part of Ser. No. 468,701, Jan. 23, 1990, abandoned.

[30] Foreign Application Priority Data

Jan. 24, 1989 [JP] Japan ..... 1-14517

[51] Int. Cl.[5] ..... E04B 1/346

[52] U.S. Cl. ..... 52/66; 52/64

[58] Field of Search ..... 52/63, 64, 65, 66, 82

[56] References Cited

U.S. PATENT DOCUMENTS

| | | | |
|---|---|---|---|
| 4,706,419 | 11/1987 | Adachi et al. | 52/66 X |
| 4,751,800 | 6/1988 | Kida et al. | 52/66 |
| 5,007,214 | 4/1991 | Itami et al. | 52/64 X |
| 5,058,332 | 10/1991 | Masuyama et al. | 52/64 X |

*Primary Examiner*—David A. Scherbel
*Assistant Examiner*—Creighton Smith
*Attorney, Agent, or Firm*—James H. Tilberry

[57] ABSTRACT

A structure having a movable dome-type roof including a plurality of independently movable shell sections which nest one beneath the other. A frame superstructure is arched over the dome to support the upper ends of the shell sections. The lower edges of the shell sections are mounted on self-powered carriages and are independently shiftable about a circular base of the structure. By selectively shifting individual shell sections, the dome may be contracted or expanded as desired. The superstructure may be mounted on a circular track or on a pair of linear tracks to expedite the opening and closing of the dome.

41 Claims, 13 Drawing Sheets

MOVABLE DOME-TYPE ROOF FOR STRUCTURE

This is a continuation-in-part of prior application Ser. No. 07/468,701, filed Jan. 23, 1990, now abandoned.

BACKGROUND OF THE INVENTION

1. Field of the Invention

The field of this invention relates to movable dome-type roofs composed of a plurality of movable sections and the means for shifting these movable sections to open and to close.

2. Description of the Prior Art

Heretofore, various movable domes have been proposed, but the mechanism for moving a dome which covers a large area is generally complicated and massive in scale. Since the dome portion itself is massive, it is liable to become structurally unstable during opening and closing operations. Furthermore, since the conventional movable dome-type roof is complicated and massive and the dome portion requires exceptional structural stability, the construction period is lengthy and expensive. Maintenance also becomes a problem with such massive movable prior art mechanisms, thereby increasing the overall cost of the installation. Research and development required to solve the problems of prior art devices is yet an additional cost burden which must be borne by these devices.

BRIEF SUMMARY OF THE INVENTION

The invention comprises a movable dome divided into a plurality of substantially triangular sections or shell sections adapted to be selectively shifted about a horizontal circular base. Each shell section has an upper apex secured to a shaft depending from the apex of a parabolic-shaped frame or superstructure. Each shell section is adapted to pivot about the shaft, the axis of which is concentric with the circular base. Locomotion means are associated with the lower edge of each shell section. The shell sections are configured to nest one above the other, and are supported at their upper apices on the superstructure shaft and at their lower edges on the horizontal circular base.

In the preferred embodiment of the invention, the superstructure may be moved linearly toward and away from the circular base. In another preferred embodiment of the invention, it may be rotated about the circular base. In yet another preferred embodiment of the invention, the superstructure may be selectively shifted linearly or rotationally relative to the circular base. The superstructure may be supported for movement on standard railway undercarriage trucks to roll on rails on a grade level track bed. In another preferred embodiment, the superstructure may be supported for movement on pressurized fluid pads.

The foregoing described movable dome-type roof is simple in concept and has a minimum number of parts, which facilitates construction and reduces construction costs.

OBJECTS OF THE INVENTION

It is therefore among the objects of the present invention to provide an improved movable dome-type roof which permits the removable mechanism of the dome portion to be simplified; which obtains the requisite structural stability of the dome portion during the opening and closing operations thereof; which permits the dome itself to be simply constructed and maintained substantially trouble free; and which provides several means of selectively moving dome sections to partially open, to fully open, or to close the inventive dome-type roof.

DESCRIPTION OF PREFERRED EMBODIMENTS OF THE INVENTION

Figure 1:
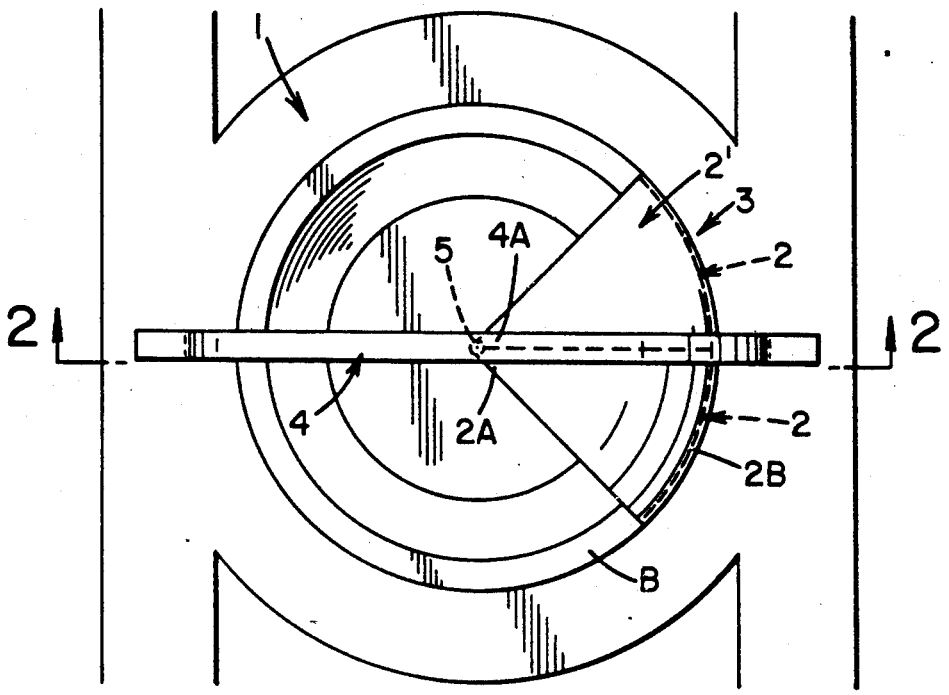
FIG. 1 is a schematic plan view showing a movable dome-type roof according to the present invention.
Figure 2:
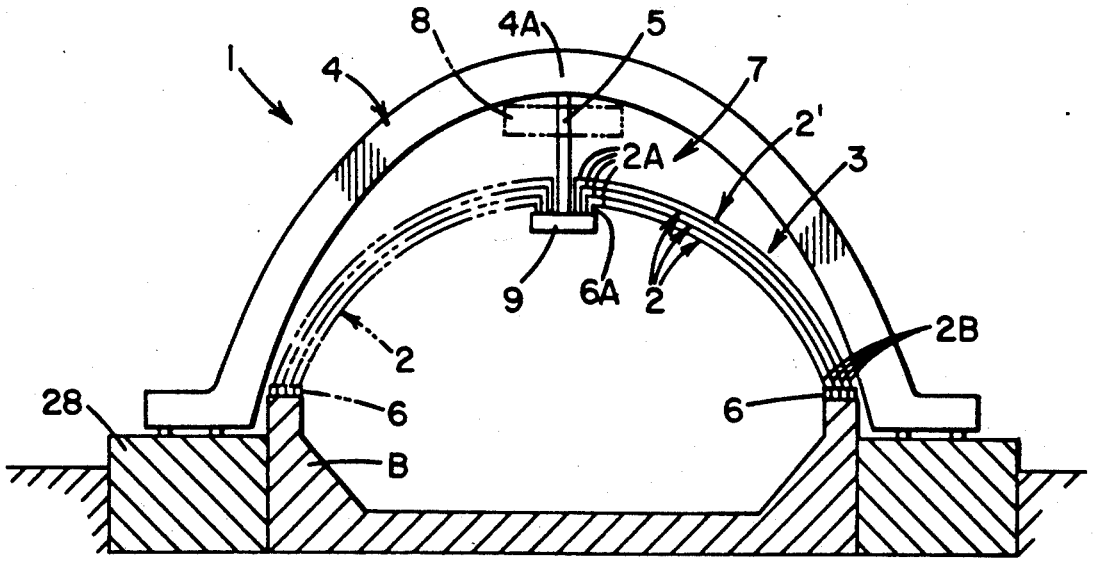
FIG. 2 is an elevational view partially in section taken along the line 2—2 of FIG. 1.
Figure 3:
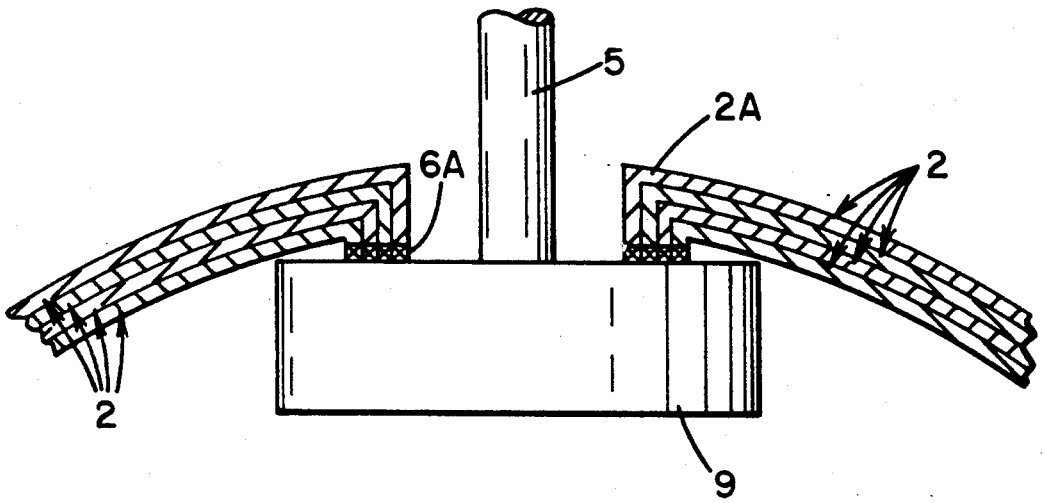
FIG. 3 is a fragmentary enlarged elevational view partially in section showing means of supporting the upper apices of the shell sections by the superstructure shaft.
Figure 4:
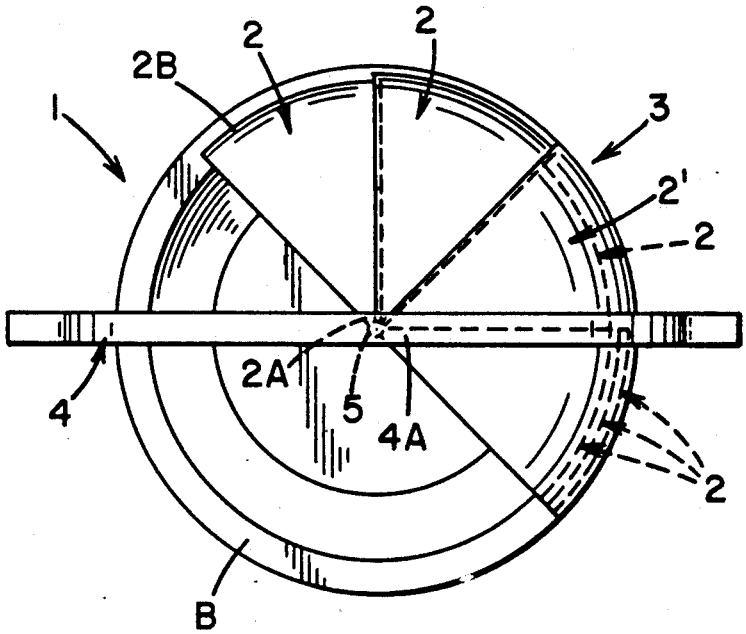
FIG. 4 is a partial plan view of a preferred embodiment of the invention showing the shell sections enclosing one-half of the roof of a structure.
Figure 5:
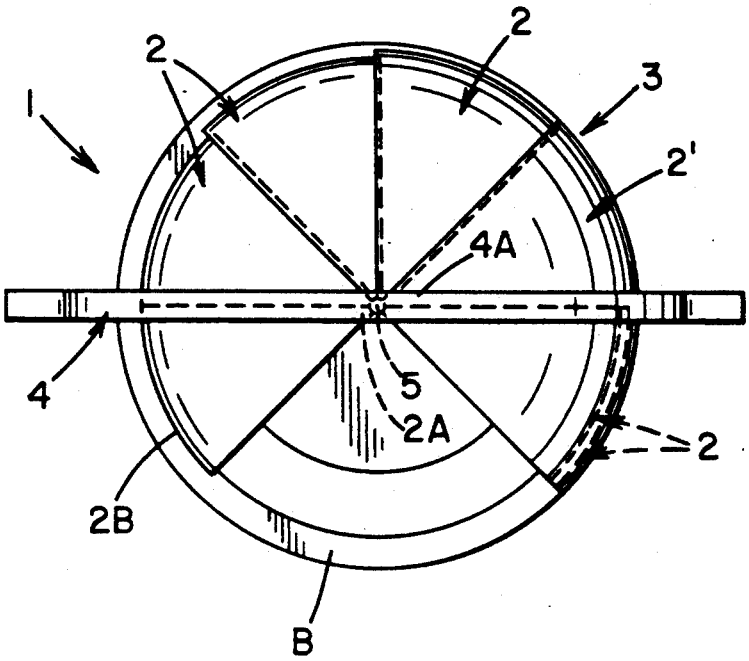
FIG. 5 is a partial plan view of a preferred embodiment of the invention showing the shell sections enclosing three-quarters of the roof of a structure.
Figure 6:
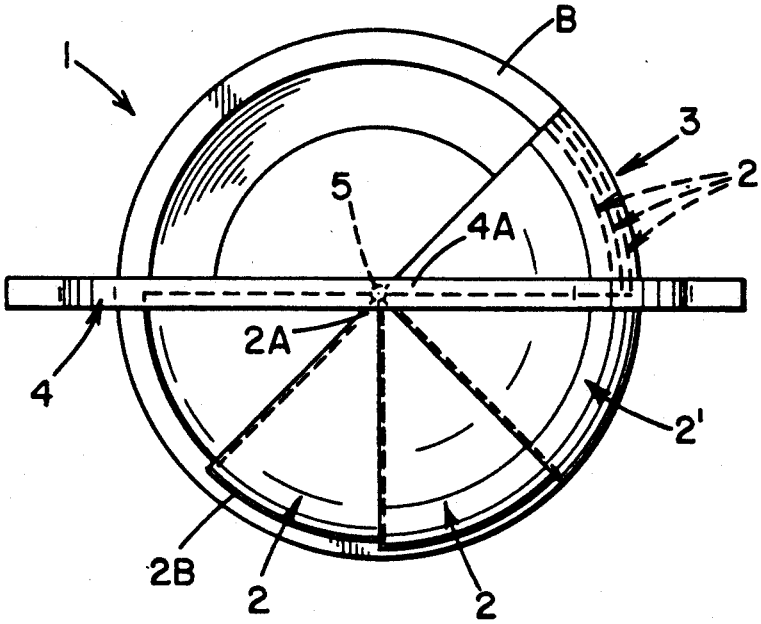
FIG. 6 is a partial plan view of a preferred embodiment of the invention showing the shell sections enclosing five-eighths of the roof of a structure.
Figure 7:
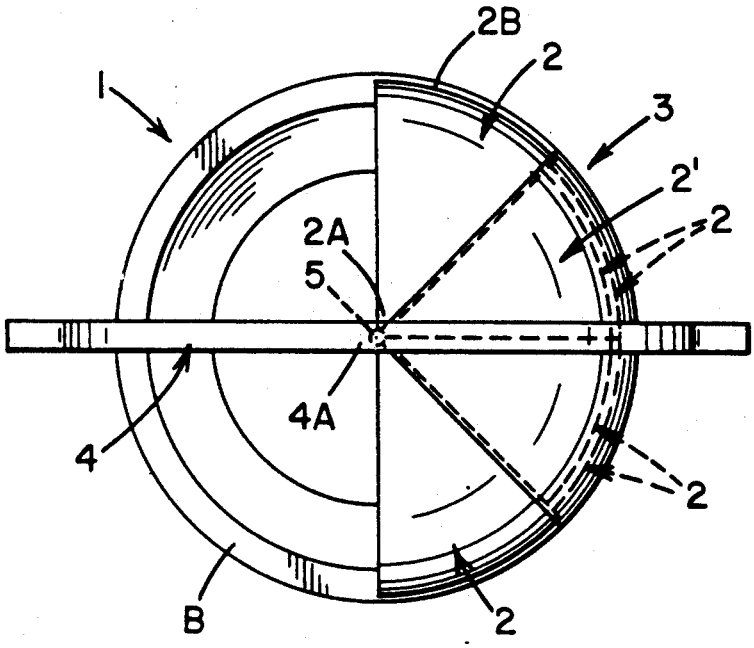
FIG. 7 is a partial plan view of a preferred embodiment of the invention showing the shell sections enclosing one-half of the roof of a structure.

According to the present invention as shown in FIGS. 1 and 2, a movable dome-type roof 1 comprises a dome portion 3 composed of a plurality of shell sections 2 and a superstructure frame portion 4 arched over and spaced above the dome portion 3. Each shell section 2 has an apex portion 2A supported by a shaft 5 mounted in the apex 4A of the arched superstructure frame portion 4 and is adapted to pivot about the shaft 5 on anti-friction bearing means 6A, FIG. 3. The lower edges 2B of shell sections 2 are mounted on self-propelled carriages 6 which selectively transport the shell sections about base B. The shell sections are designed to nest one beneath the other, as shown in FIGS. 2 and 3.

Figure 8:
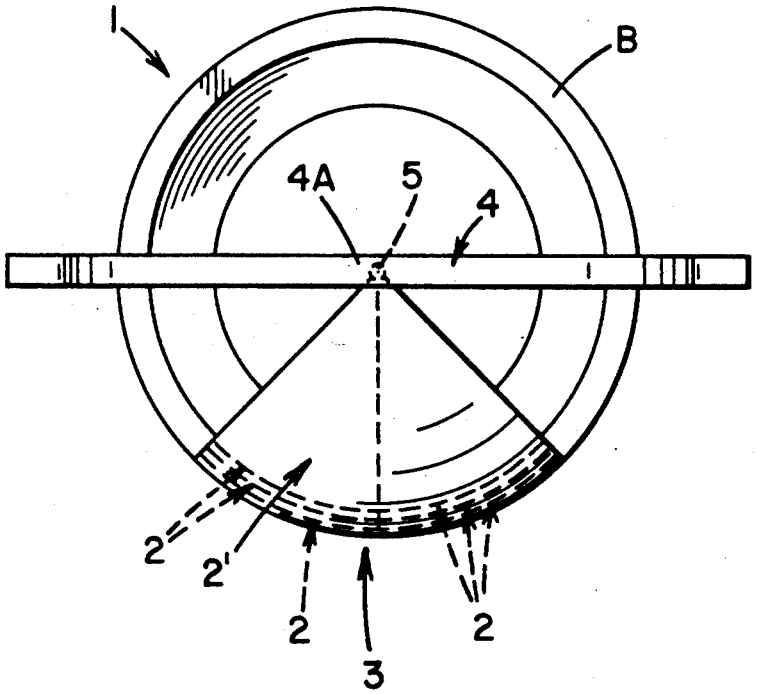
FIG. 8 is a partial plan view of a preferred embodiment of the invention showing the shell sections enclosing one-fourth of the roof of a structure.
Figure 9:
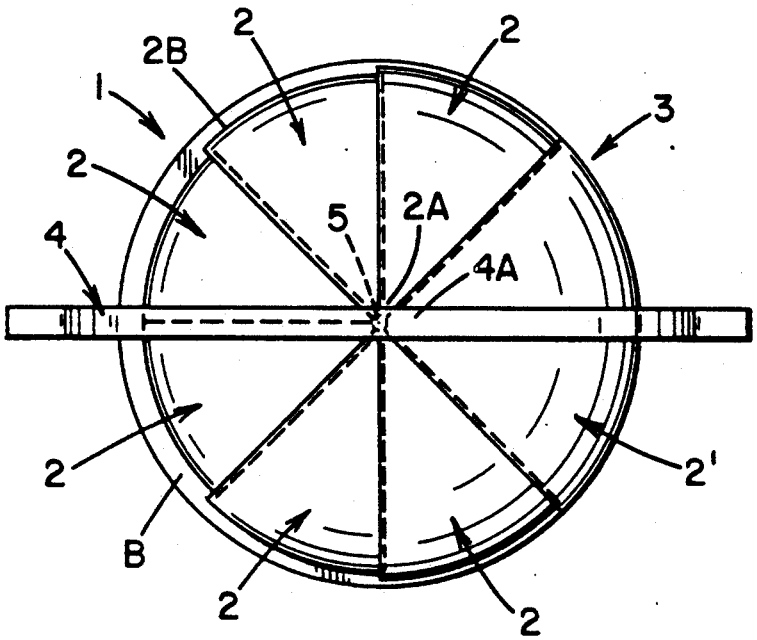
FIG. 9 is a partial plan view of a preferred embodiment of the invention showing the shell sections enclosing the entire roof of a structure.

In the preferred embodiment of the invention shown in FIG. 9, the dome comprises six shell sections 2 of equal size, and one shell section 2' twice the size of each shell section 2. The six uniform shell sections 2 nest beneath shell section 2', as shown in FIG. 8. The superstructure frame portion 4, according to the preferred embodiment of the invention shown in FIG. 2, comprises a parabolic arch, although other arched configurations will suffice, providing that they have the strength to support the dome and provide adequate clearance space between the arch and the dome.

Clearance space 7, FIG. 2, may be utilized to install photographic, telescopic, and/or related equipment 8 capable of making records and observations both inside and outside the domed structure. In addition, accessory equipment, such as lighting for use when the dome portion 3 is closed, may also be included as equipment 8 in space 7.

Equipment compartment 9 shown in FIG. 2 is provided on the lower end of the shaft 5 for the purpose of mounting observation equipment beneath the dome 3, as well as accessory equipment, such as lighting means.

In use, the pivotal movement of each shell section 2, supported by the shaft 5 and structure base B and mounted on self-propelled carriages 6, may be selectively rotatably shifted to open and to close the dome portion 3. Furthermore, selective rotatable shifting of shell sections 2 may be undertaken to obtain any of the dome modes from substantially opened, as shown in FIG. 1, or partially opened, as shown in FIGS. 4, 5, 6, 7 and 8, to completely closed, as shown in FIG. 9.

Figure 10:
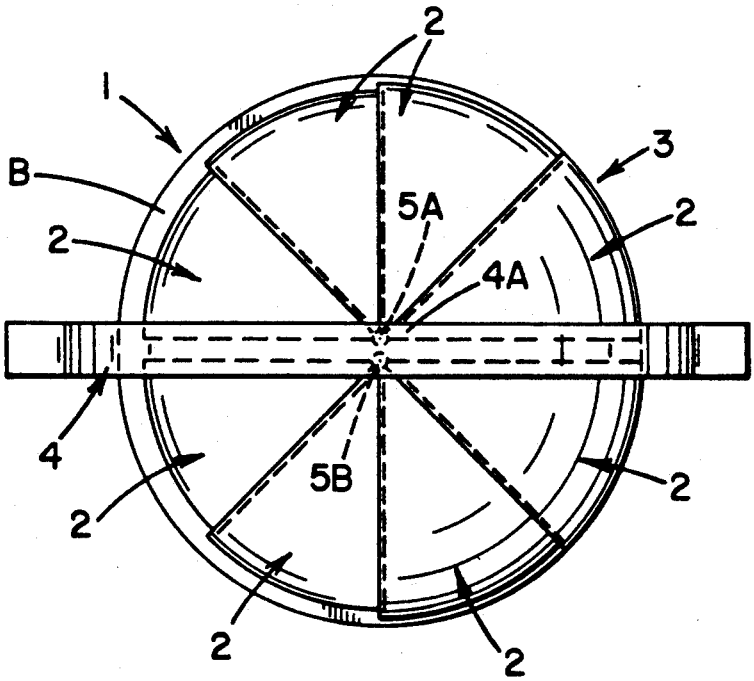
FIG. 10 is a partial plan view of a preferred embodiment of the invention showing the apices of the shell sections supported by two superstructure shafts.

FIG. 10 shows another embodiment of the structure 1 with a movable dome-type roof 3 according to the present invention. In this embodiment, a pair of shafts 5A and 5B are provided in lieu of the single shaft 5 of FIGS. 1 through 9. The respective shell sections 2 constituting the dome portion 3 are divided into two equal sets of shell sections, whereby each set is supported by the corresponding shafts 5A or 5B. Thus, since the number of the shell sections 2 supported by each shaft 5 is reduced by one half, the supporting structure of each shaft may be simplified.

Figure 11:
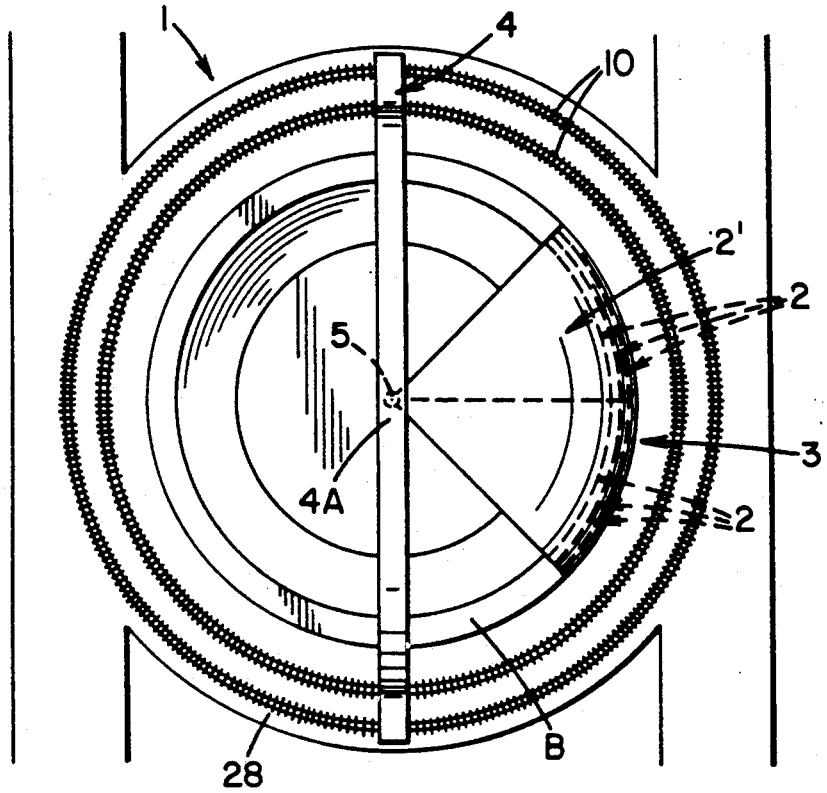
FIG. 11 is a plan view of a preferred embodiment of the invention showing the arched superstructure in a rotated position.

FIG. 11 illustrates a superstructure frame which may be rotatably shifted about the periphery of the structure base B on dual standard gauge railway tracks 10.

Figure 12:
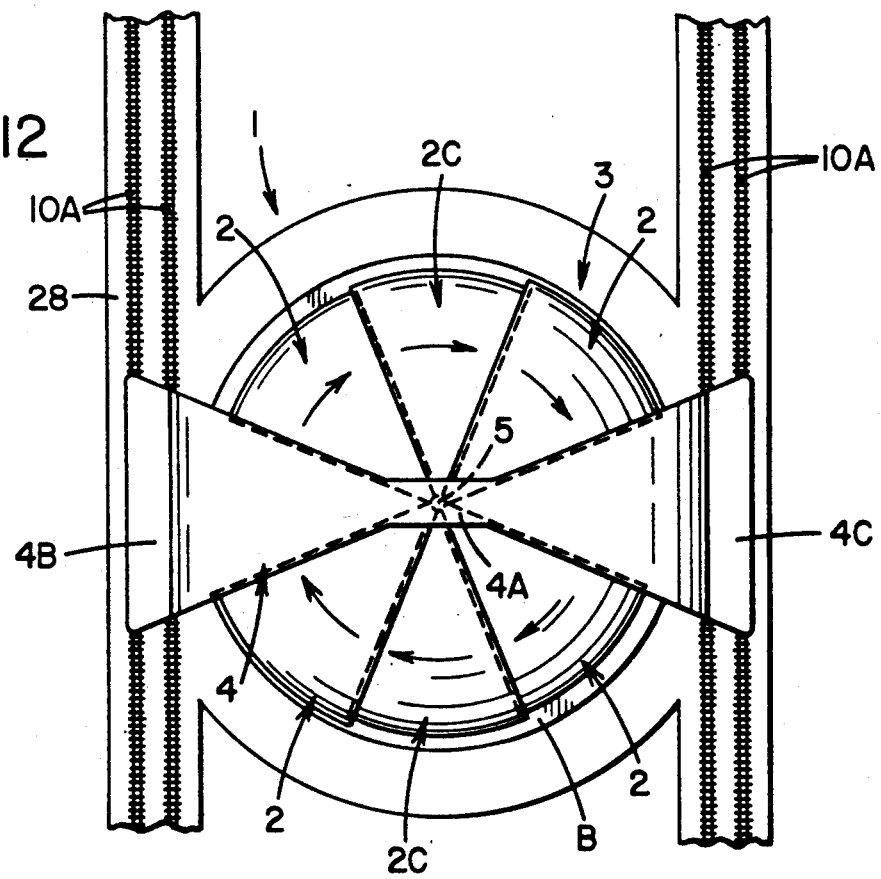
FIG. 12 is a plan view of another preferred embodiment of the invention showing a modified arched superstructure, the shell sections fully enclosing the roof, and means to linearly shift the arched superstructure.
Figure 13:
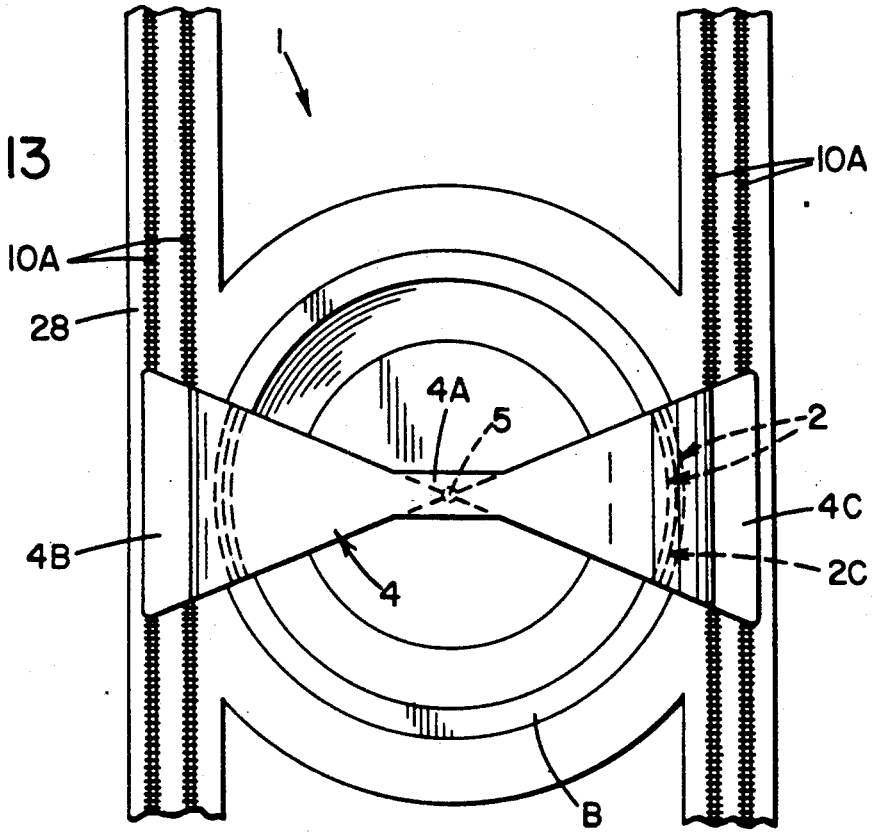
FIG. 13 is a plan view of the embodiment of the invention shown in FIG. 12, with the shell sections enclosed beneath the superstructure.
Figure 14:
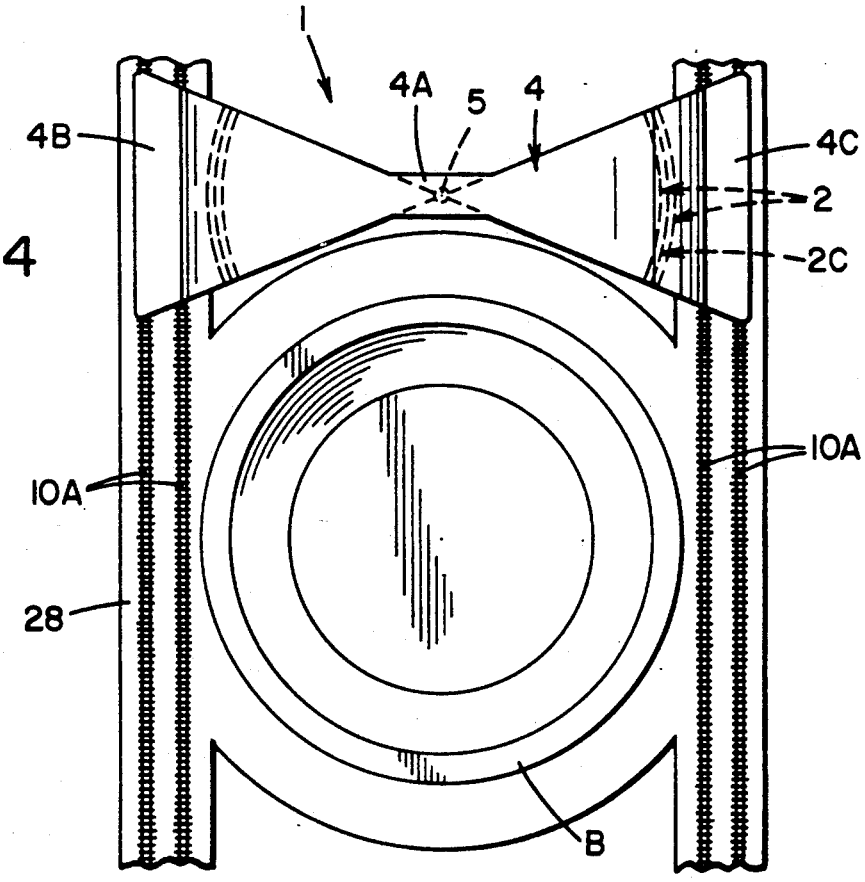
FIG. 14 is a plan view of the embodiment of the invention shown in FIG. 13, but with the superstructure linearly shifted to one side of the base structure.

FIGS. 12 through 14 show a further embodiment of the movable dome-type roof 3 according to the present invention. In this embodiment, the arched frame portion 4 is transverse to, and adapted to be shifted along, pairs of linear tracks 10A which straddle the structure 1, so as to shift the entire roof 3 laterally to and from the structure base B. This embodiment provides an alternate means of fully closing or fully opening the structure 1 without sacrificing the flexibility of adjusting the dome openings with the frame 4 in place centered over the structure base B.

The arched frame portion 4 shown in FIG. 12 has opposed lower portions 4B and 4C, each of which is similar in shape to each shell section 2. An opposed pair of shell sections 2C are made rigidly integral to stabilize the shell sections 2 for greater ease of pivotal movement about base B. By moving the pair of rigidly integral shell sections 2C in the direction shown by arrows in FIG. 12, the pair is moved to beneath the arched frame portion 4, FIG. 13. In addition, the pair of shell sections 2C, as well as shell sections 2, are moved to beneath the arched frame portion 4 and lifted onto the pedestal 20 of FIGS. 16 and 17 formed on the lower end of the arched frame portion 4. With shell sections 2 and shell sections 2C resting on pedestal 20, the entire stacked assembly of pairs of shell sections may be moved together with the arched frame portion 4 toward or away from the structure base B to quickly open or close the structure 1, as shown in FIG. 14.

Figure 16:
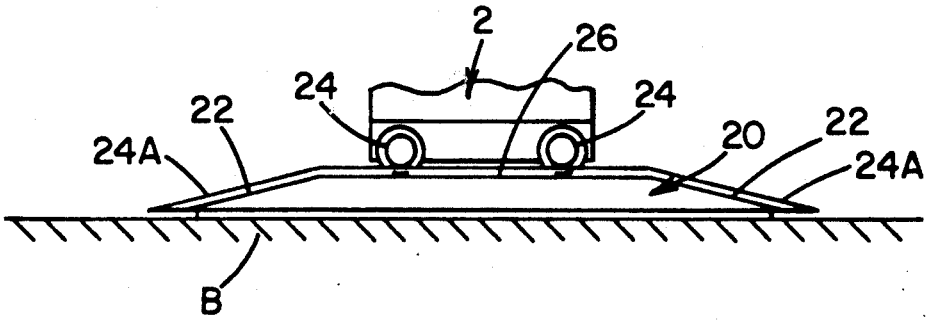
FIG. 16 is a fragmentary elevational view of a shell carriage and the pedestal means for carrying the shell carriage on the arched superstructure.
Figure 17:
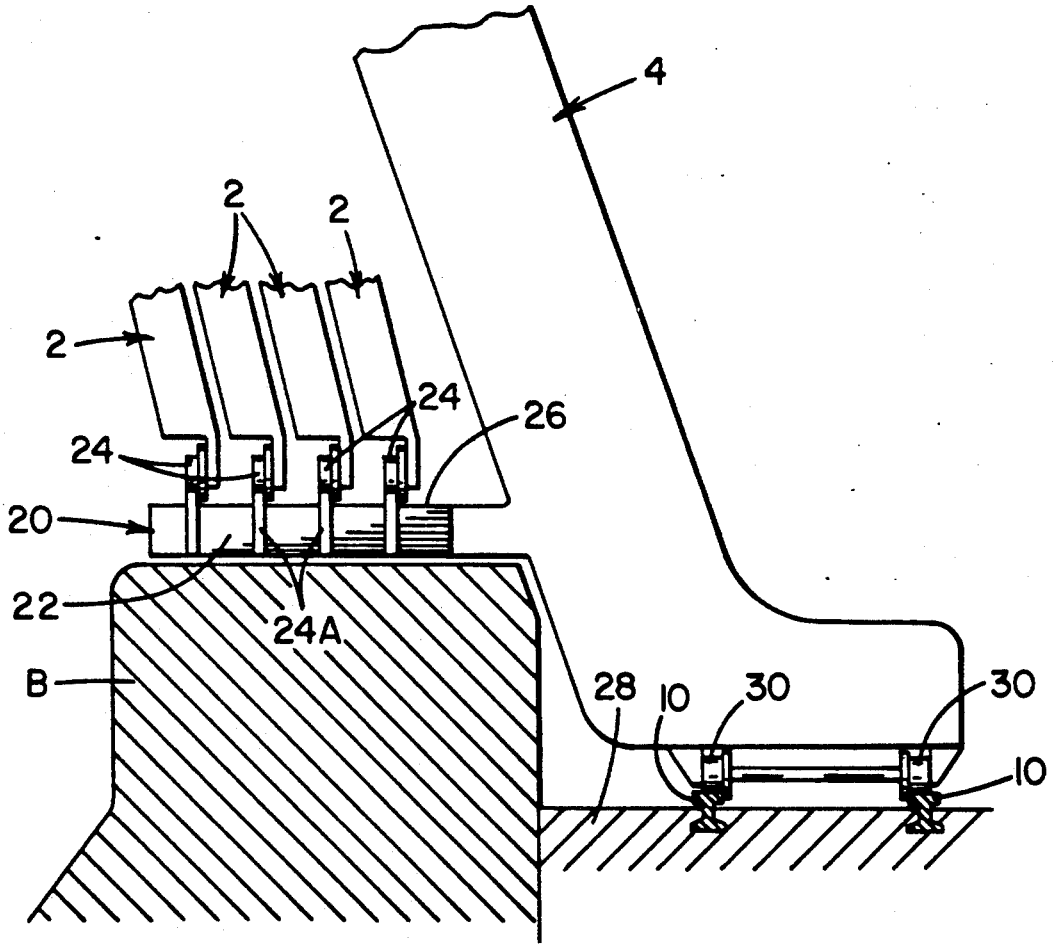
FIG. 17 is a fragmentary elevational view of the structure base, the arched superstructure, a shell-carrying pedestal, and shells carried on the pedestal.

As shown in FIGS. 16 and 17, a pedestal 20 provided with ramps 22 on opposite sides may be secured to arched frame portion 4 and positioned to extend horizontally over shell base B in line with shell rollers 24, guided on tracks 24A. As each shell section 2 is shifted toward arched frame portion 4, the leading roller 24 will engage the nearest ramp track 24A, which will guide the shell section 2 until it is centered on the platform portion 26 of pedestal 20.

As previously discussed and as shown in FIG. 11, it is contemplated that arched frame portion 4 may be rotatable about base B on track 10. As further shown in FIGS. 12 and 13, it is also contemplated that arched frame portion 4 be adapted to move linearly along tracks 10A. In order to move arched frame 4 on either tracks 10 or 10A, an arch frame base 28, FIG. 17, is provided to encircle shell base B and to project linearly beyond the limits of the structure 1. Tracks 10 or 10A are secured in the base 28 to carry arch railway-type wheels 30.

Figure 15:
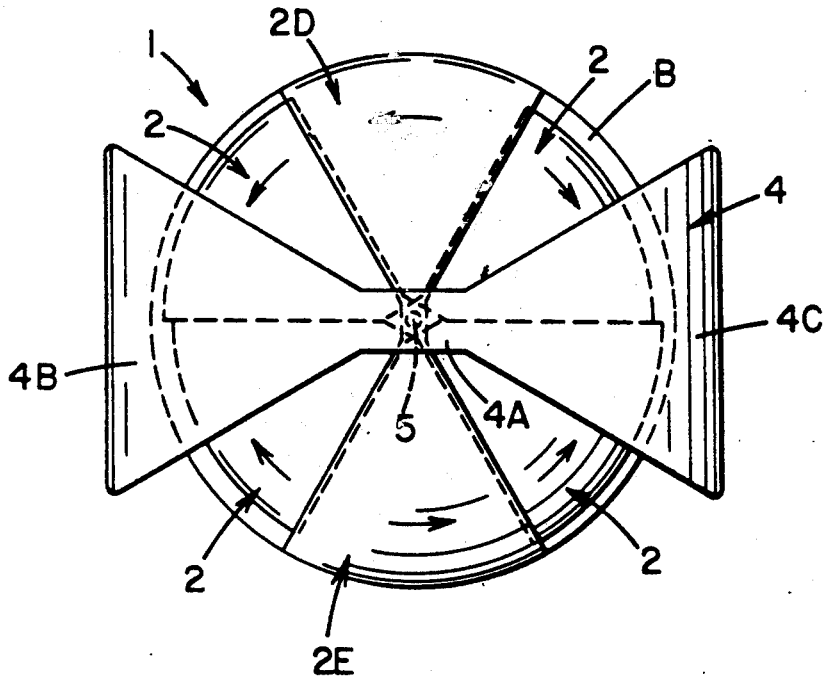
FIG. 15 is a partial plan view of yet another preferred embodiment of the invention, showing a pair of shell sections permanently diametrically positioned.

Referring to FIG. 15, one or more pairs of opposed shell sections, such as 2D and 2E, may be integrally secured at their apices, and arched frame 4 may be formed with flared pedestals 4B and 4C, FIG. 12, so as to approximate the configuration of a pair of integrally secured shell sections. Although preferred embodiments illustrated in the drawings show domes with six and eight shell sections, fewer or more shell sections may be used.

From the foregoing it will be understood that within the inventive concept various combinations of shell sections may be used as to size, number, arrangement, and combination.

Figure 18:
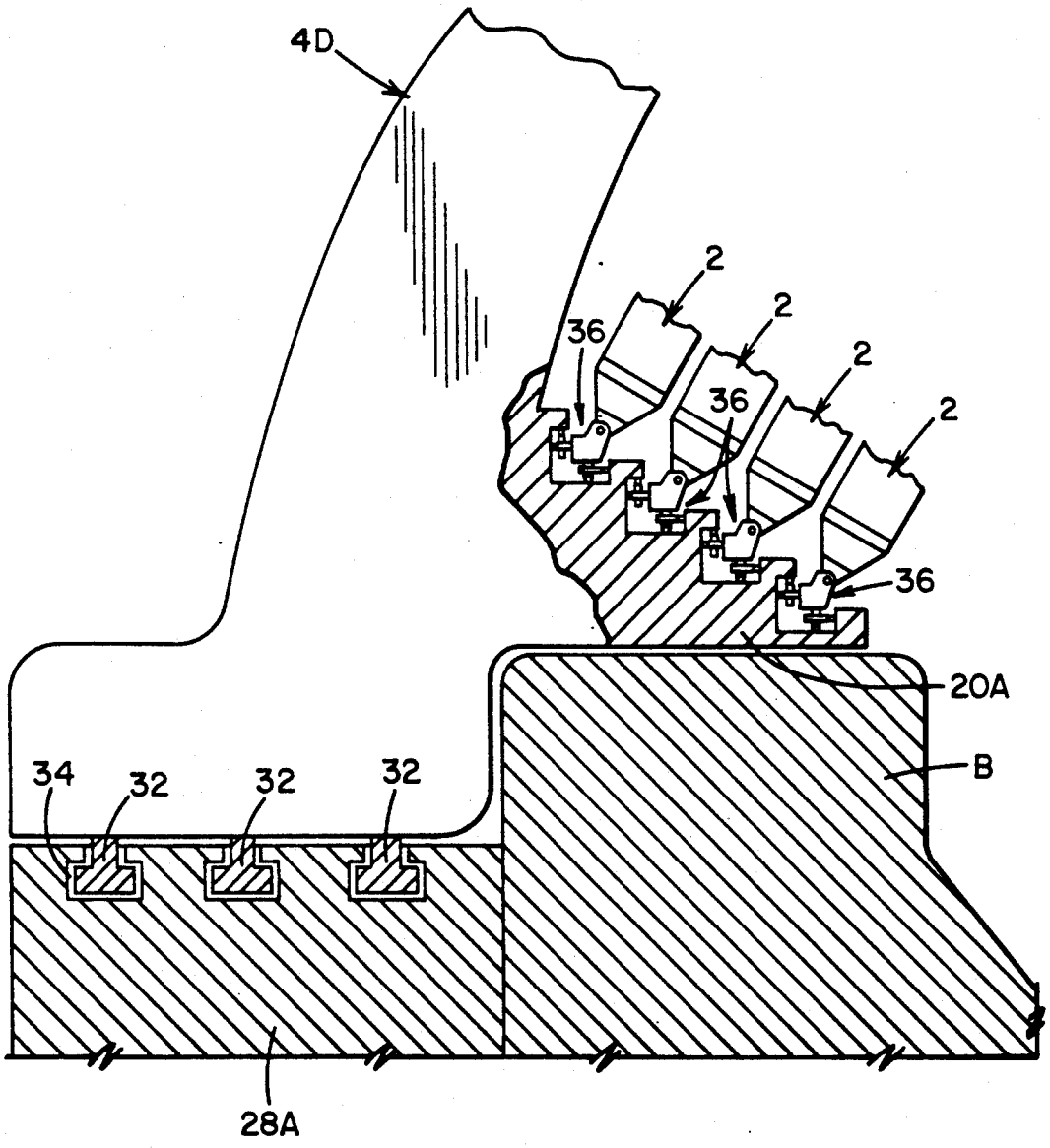
FIG. 18 is a fragmentary elevational view similar to FIG. 17, showing alternative means for supporting the arched superstructure and the shell carriages.

Referring to FIG. 18, therein are shown modified embodiments of the arched frame 4, pedestal 20A, and shell sections 2 previously discussed with respect to FIG. 17. In the FIG. 18 embodiment, the arched frame 4D is fluid-supported on a cushion of air or liquid, such as oil, by means of cushion pads, schematically shown at 32. These pads 32 are adapted to make fluid pressure sealing engagement in longitudinal fluid chambers 34 formed adjacent the top surface of parallel linear extensions of arch base 28A which extend on opposite sides of the shell base B, similar to the base 28, schematically illustrated in FIGS. 11 and 12. With this embodiment of the invention, it is contemplated that arched frame 4D may be shifted linearly but not rotationally, as arch frame 4 in FIG. 12.

Arch frame pedestal 20A projects parallel over the top surface of shell base B with minimum clearance between the pedestal 20A and the shell base B. Pedestal 20A is shown stepped to support shell base self-propelled carriages 36. Elevating carriages 36 stepwise as shown and the degree of elevation are a matter of choice over the planar pedestal 20 of FIG. 17. When the carriages 36 are sequentially stepped, the height differential between carriages is compensated for at the apices of the shells where ample space is provided on the top surface of compartment 9 for the shell apices to horizontally shift one from another, as required. Thus, the top shell will shift the greatest amount radially upward, whereas the subjacent shells will shift proportionately lesser amounts to achieve the required compensation for vertical elevation of the shell base carriages 36.

Figure 19:
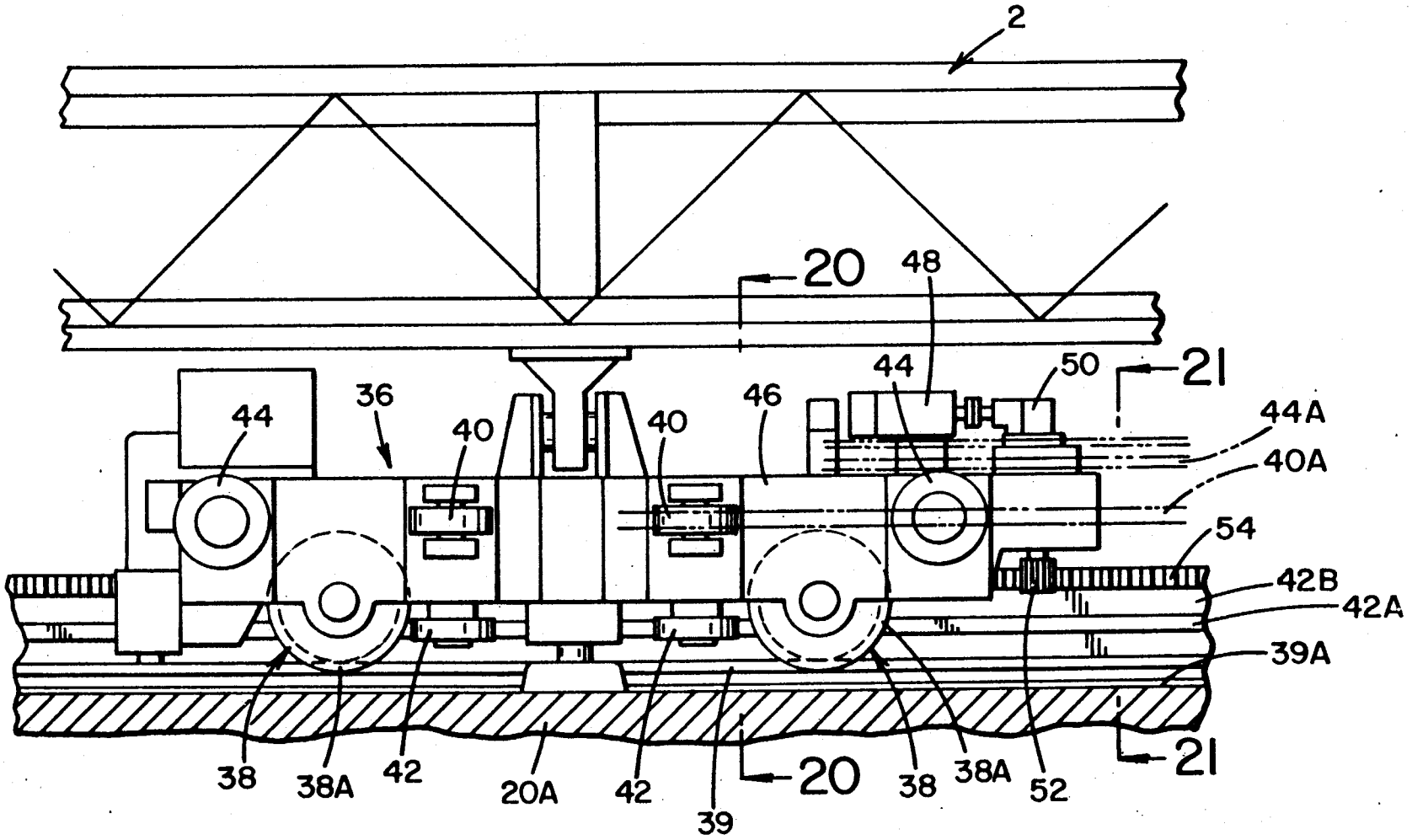
FIG. 19 is an elevational view of a preferred embodiment of the shell carriage of FIG. 18.
Figure 20:
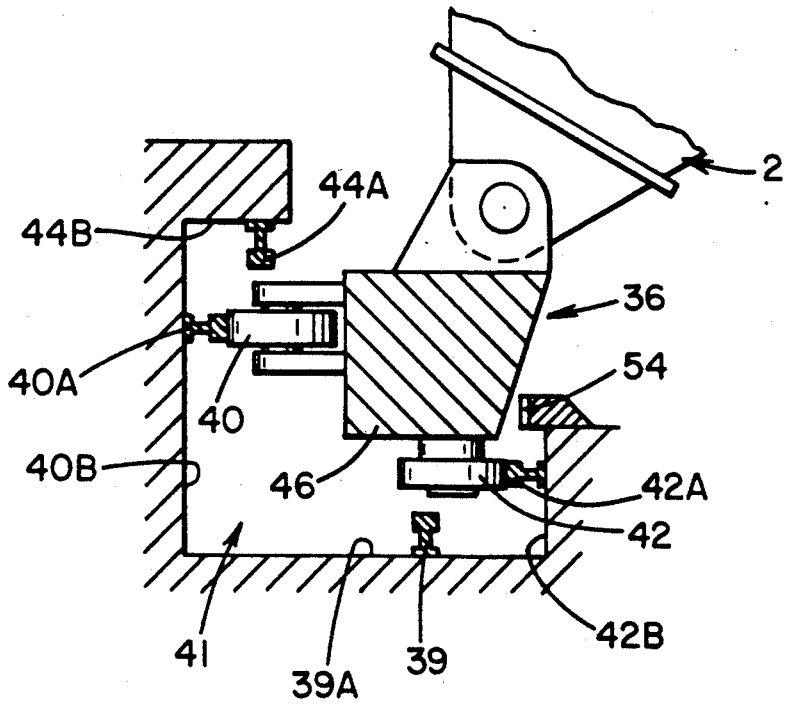
FIG. 20 is an elevational sectional view of the shell carriage of FIG. 19 taken along the line 20—20 of FIG. 19.
Figure 21:
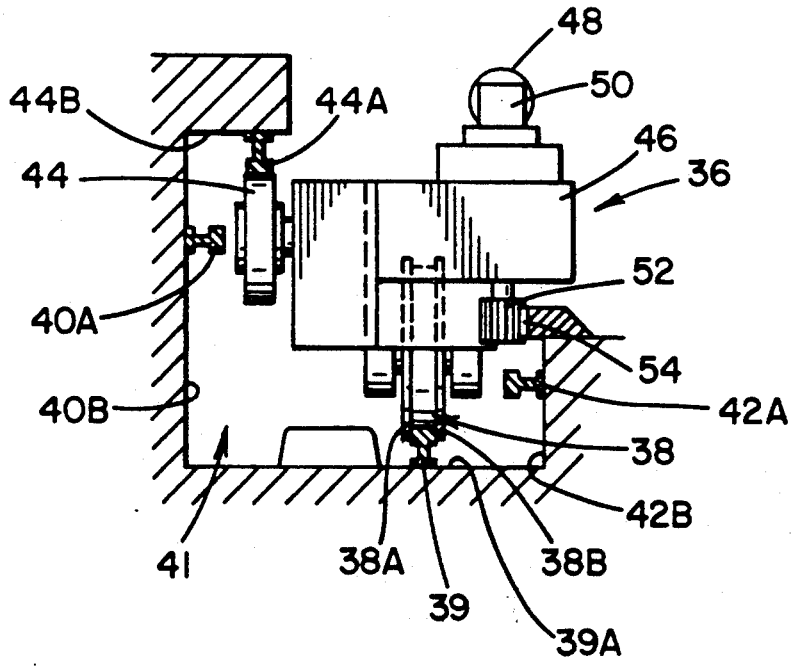
FIG. 21 is an elevational view of the shell carriage of FIG. 19 taken along the line 21—21 of FIG. 19.

A preferred embodiment of the shell base carriage is illustrated in FIGS. 19, 20, and 21. FIG. 19 is a side elevational view of the carriage 36 which comprises a pair of main vertical support guide wheels 38, two pairs of lateral thrust guide wheels 40–42, and a pair of vertical down thrust guide wheels 44. The wheels are rotatably mounted on the carriage frame 46. The carriage 36 is driven by motor means 48, gear reduction transmission 50, and pinion 52. Each pinion 52 drivingly engages a segmented gear rack 54 secured to a step of the arch pedestal 20A. Extensions of racks 54 concentrically encircle the shell base B, whereby each shell is individually motorized and selectively positionable about shell base. Wheels 38 are provided with side rims 38A and 38B, FIG. 21, which maintain wheels 38 in rolling contact with single track 39 secured to base 39A of pit 41. A single track 40A, FIG. 20, is secured to back wall 40B of pit 41 and is aligned with lateral thrust guide wheel 40 to provide rolling engagement therewith. In like manner, single track 42A is secured to front wall 42B of pit 41, and is aligned with lateral thrust guide wheel 42 to provide rolling engagement therewith. Single track 44A is secured to overhead wall 44B of pit 41 and is aligned with vertical down thrust wheels 44, FIG. 21, to provide rolling engagement therewith. This arrangement of wheels, tracks, and pit supporting walls serves to stabilize carriage 36 to follow a predetermined path around the circular base B.

Figure 22:
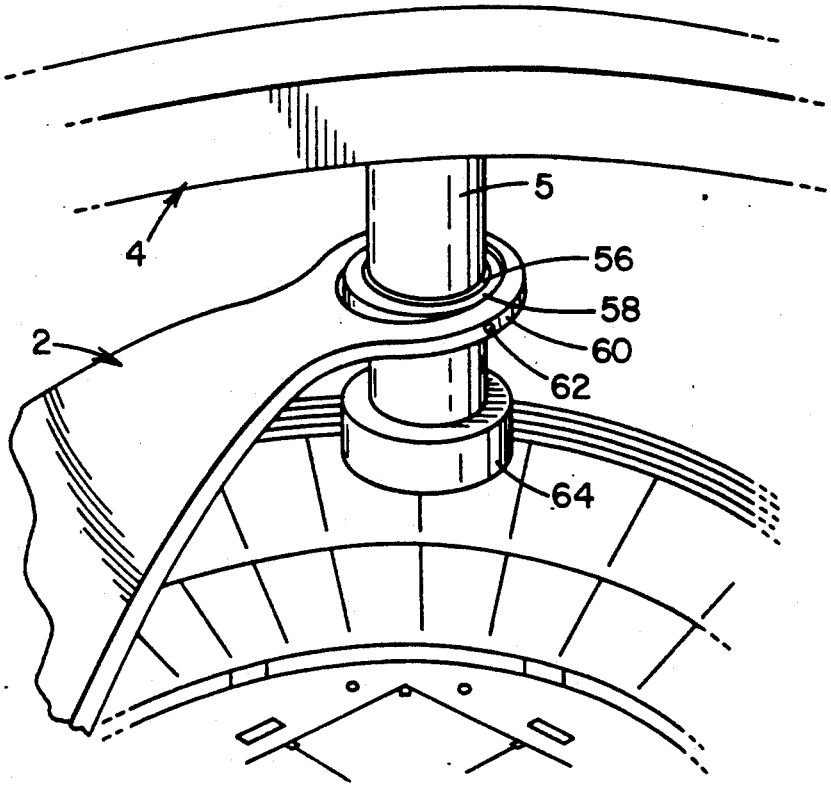
FIG. 22 is a perspective view of the apex of the arched superstructure, showing the apex shell supporting means.
Figure 23:
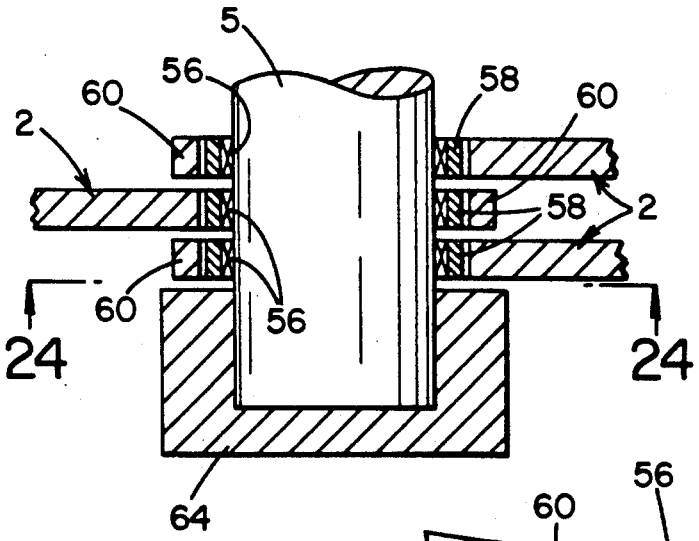
FIG. 23 is a fragmentary elevational view, partially in section, showing the apex shell supporting means with interior detail, taken substantially along the line 23—23 of FIG. 24.
Figure 24:
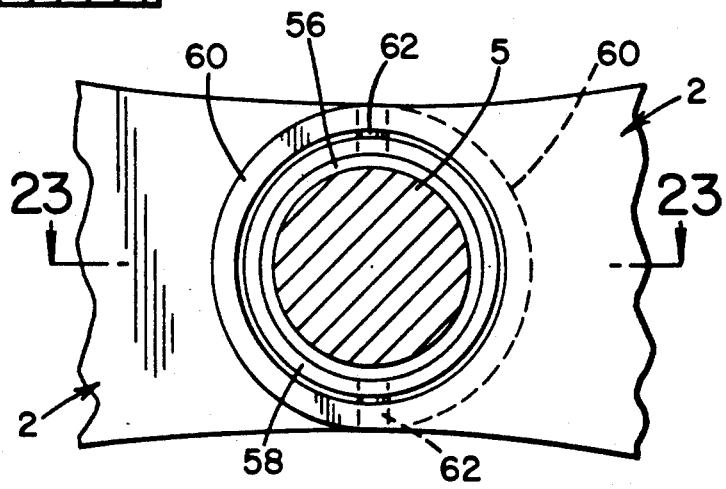
FIG. 24 is a fragmentary cross-sectional view taken along the line 24—24 of FIG. 23.

Referring to FIG. 22, which is a perspective view of the inventive domed structure taken at approximately the apex of the arched frame 4, therein is shown a preferred means of positively securing the apices of the shells 2 to the dome supporting shaft 5. With the shaft 5 serving as an inner bearing race, FIG. 23, bearings 56 are encased in an outer bearing race 58 which serves as a turning ring. The apex of each shell is provided with a shaft mounting ring 60 which loosely encircles turning ring 58 and is pivotally secured thereto by means of a pair of diametrically opposed pins 62, to permit pivotal movement about a horizontal axis. Rings 58 and 60 for each shell 2 concentrically stack on shaft 5 and are supported by shaft end cap 64. When the shell carriages are vertically stepped as shown in FIG. 23, carriage vertical displacement is compensated at the apex of each shell by pivotal movement of the shaft mounting ring 60 about pins 62 secured to turning ring 58, as best shown in FIG. 22. Although only one turning ring-/mounting ring combination is shown in FIG. 22, it is to be understood that the same number of turning ring-/mounting ring combinations will be mounted on shaft 5 as there are shells in the domed structure. See FIG. 23.

It will occur to those skilled in the art, having studied the described preferred embodiments of the invention, and having read the specification in conjunction with a study of the drawings, that certain modifications may be made to the invention. It is intended, however, that the invention be limited only by the scope of the appended claims.

We claim:

1. A structure with a movable dome-type roof comprising: a circular base; an arched superstructure having an apex and diametrically opposed pedestals supported on opposite sides of said circular base and an apex concentric with the center of said circular base; arched superstructure base means; a plurality of shell sections having upper apex means and lower base means adapted to be supported between the apex of said arched superstructure and said circular base; said shell sections being adapted to rotate about a vertical axis defined by said apex of said arched superstructure and the center of said circular base, and to nest one beneath another; means to shift said shell sections about said vertical axis; and means to shift said arched superstructure on said arched superstructure base means relative to said circular base.

2. The structure of claim 1, including track means encircling said circular base; wheel means adapted to provide rolling support for said arched superstructure diametrically opposed pedestals on said track means; and means to shift said arched superstructure on said track means about said circular base.

3. The structure of claim 1, including linear track means extending parallel on opposite sides of said circular base; wheel means adapted to provide rolling support for said arched superstructure diametrically opposed pedestals on said linear track means; and means to shift said arched superstructure on said linear track means.

4. The structure of claim 1, including first track means encircling said circular base; second track means extending linearly parallel on opposite sides of said circular base; wheel means adapted to provide rolling support for said arched superstructure diametrically opposed pedestals on said track means; and switching means adapted to switch said wheel means between said first and second track means.

5. The structure of claim 1, including fluid pressure pad means secured to the undersides of said arched superstructure diametrically opposed pedestals; linear fluid pressure chamber means extending parallel on opposite sides of said circular base; said fluid pressure pad means being adapted to be received within said linear fluid pressure chamber means and in fluid pressure sealing engagement therewith; means to pressurize said linear fluid pressure chamber means; and means to shift said arched superstructure over said linear fluid pressure chamber means when said linear fluid pressure chamber means have been fluid pressurized.

6. The structure of claim 1, wherein said shell sections have upper apices and suspension means suspended from said apex of said arched superstructure adapted to support the apices of said shell sections.

7. The structure of claim 6, wherein said suspension means is adapted to suspend said apices of said shell sections a substantial distance beneath the said apex of said arched superstructure.

8. The structure of claim 7, wherein said suspension means is provided with a platform and said apices of said shell sections are adapted to be supported by said platform.

9. The structure of claim 8, including compartment means secured to the underside of said platform adapted to receive, store, and operate operational equipment for said structure.

10. The structure of claim 8, including compartment means secured to said suspension means above said shell section apices.

11. The structure of claim 10, wherein said compartment means are secured to said suspension means proximate said apex of said arched superstructure.

12. The structure of claim 8, said shell sections having lower edges adapted to rest on said circular base; anti-friction means secured to said shell section apices adapted to engage said platform; and anti-friction means secured to said lower edges of said shell sections adapted to engage said circular base.

13. The structure of claim 6, wherein said arched superstructure is configured to substantially enclose said shell sections therebeneath.

14. The structure of claim 13, wherein said shell sections are substantially triangular in configuration, and said arched superstructure comprises a pair of triangular members joined at their apices at said apex of said arched superstructure, said triangular members being sized to substantially enclose said shell sections therebeneath.

15. The structure of claim 1, including pedestal means secured to said arched superstructure and projecting horizontally inwardly therefrom to extend over said circular base and adapted to receive and support said shell sections thereon whereby said shell sections and said arched superstructure are adapted to be shifted in unison on said arched superstructure base means.

16. The structure of claim 15, including wheel means secured to said arched superstructure diametrically opposed pedestals adapted to permit shifting said arched superstructure on said arched superstructure base means.

17. The structure of claim 15, including fluid pressure pad means adapted to permit shifting of said arched superstructure on said arched superstructure base means.

18. The structure of claim 15, wherein said horizontally projecting pedestal is stair-stepped to receive said shell sections on said horizontally projecting pedestal at different preselected horizontal levels.

19. The structure of claim 1, including carriage means adapted to transport said shell sections about said circular base, each carriage comprising load bearing roller means adapted to support a shell section; vertical thrust roller means; lateral thrust roller means; pinion means adapted to drivingly engage rack means; pinion drive means; said circular base means including an open circular pit in said circular base means adapted to receive and to guide said carriage means; said circular pit having a base, a front wall, a back wall, and an overhead wall; said load bearing roller means being adapted to run on said pit base; said vertical thrust roller means adapted to engage said overhead wall; said lateral thrust roller means adapted to engage said back wall; circular rack means mounted on said front wall adapted to mesh with said pinion means; means to actuate said pinion drive means to rotate said pinion means in meshed engagement with said circular rack to impart movement to said carriage in said circular pit.

20. The structure of claim 19, including rail means secured to said pit base to encircle said pit; and said load bearing roller means adapted to ride on and be guided by said rail means, whereby said carriage may be driven circuitously in said circular open pit.

21. The structure of claim 19, including rail means secured to said pit base, said pit front wall, said pit back wall, and said pit overhead wall each encircling said pit; said load bearing roller means, said vertical thrust roller means, and said lateral thrust roller means being adapted to engage respective rail means to stabilize said carriage means and to support said shell sections while said pinion means drives said carriage means about said pit.

22. The structure of claim 1, including a cylindrical shell section support having an upper end and a lower end, said upper end being secured to the underside of said arched superstructure to depend vertically downward therefrom; each of said shell sections having an upper apex; ring means secured to said upper apex adapted to receive said cylindrical shell section support lower end therethrough; and means to secure said ring means to pivot about said cylindrical shell section support.

23. The structure of claim 22, including an anti-friction bearing race means rotatably secured to said cylindrical shell section support; said shell section ring means being adapted to encircle said anti-friction bearing race means; and diametrically positioned pin means adapted to pivotally secure said shell section ring means to said anti-friction bearing race means to permit arcuate pivotal movement therebetween.

24. The structure of claim 23, including sufficient tolerance between said anti-friction bearing race and said shell section ring means to permit vertical shifting of said shell sections from said circular base.

25. The structure of claim 23, including transport carriage means secured to each shell section adapted to engage said circular base; pedestal means secured to said arched superstructure projecting horizontally inwardly over said circular base; and sufficient tolerance between said anti-friction bearing race and said shell section ring to permit vertical shifting of said shell sections from said circular base onto said pedestal means.

26. The structure of claim 22, including cap means secured to said lower end of said cylindrical shell section support to retain said shell section rings thereon.

27. The structure of claim 1, wherein the apex of said superstructure is positioned substantially above said segmented dome to provide space between said arched superstructure and said segmented dome to mount equipment.

28. The structure of claim 1, wherein said arched superstructure is of parabolic configuration and the profile of said segmented dome is of cross-sectional arcuate configuration.

29. The structure of claim 1, including a pair of shafts secured to the apex of said arched superstructure to depend vertically therefrom and means on the lower ends of said shafts to support the upper apex means of said shell sections.

30. The structure of claim 29, wherein a preselected number of said shell sections are supported by one of said shafts and the remainder of said shell sections are supported by the other of said shafts.

31. The structure of claim 1, including at least one pair of diametrically opposed shell sections rigidly secured together at their upper ends to rotate in unison about said circular base.

32. The structure of claim 1, including an arched superstructure with flared opposite lower ends configured to shelter shell sections positioned thereunder.

33. The structure of claim 1, including means to suspend equipment adjacent the interior center of said segmented dome.

34. The structure of claim 1, including means to secure and suspend equipment from the apex of said arched superstructure above said segmented dome.

35. The structure of claim 1, including means to secure and suspend equipment from the apex of said arched superstructure beneath said segmented dome.

36. The structure of claim 1, said base comprising a first portion adapted to support said superstructure pedestals and a second portion adapted to support the lower edges of said shell sections.

37. The structure of claim 1, wherein said base first portion is further adapted to permit said pedestals to be arcuately shifted on said circular base.

38. The structure of claim 36, wherein said base second portion is further adapted to permit said shell sections to be arcuately shifted on said circular base.

39. The structure of claim 36, wherein said base first portion includes outer track means concentric with said circular base adapted to shiftably support said superstructure pedestals.

40. The structure of claim 36, wherein said base second portion includes inner bearing means concentric with said circular base adapted to shiftably support the said lower edges of said shell sections.

41. The structure of claim 36, wherein said base first portion includes outer track means concentric with said circular base adapted to shiftably support said superstructure pedestals and inner bearing means concentric with said circular base adapted to shiftably support the said lower edges of said shell sections.

* * * * *